US011795745B2

(12) United States Patent
Geller

(10) Patent No.: US 11,795,745 B2
(45) Date of Patent: Oct. 24, 2023

(54) FURNITURE HINGE

(71) Applicant: Julius Blum GmbH, Hoechst (AT)

(72) Inventor: Irmela Mara Geller, Dornbirn (DE)

(73) Assignee: Julius Blum GmbH, Hoechst (AT)

( * ) Notice: Subject to any disclaimer, the term of this patent is extended or adjusted under 35 U.S.C. 154(b) by 216 days.

(21) Appl. No.: 17/389,885

(22) Filed: Jul. 30, 2021

(65) Prior Publication Data

US 2021/0355726 A1 Nov. 18, 2021

Related U.S. Application Data

(63) Continuation of application No. PCT/AT2020/060008, filed on Jan. 16, 2020.

(30) Foreign Application Priority Data

Feb. 15, 2019 (AT) ..... A 50115/2019

(51) Int. Cl.
*E05D 5/00* (2006.01)
*E05D 7/04* (2006.01)

(52) U.S. Cl.
CPC ..... *E05D 7/04* (2013.01); *E05Y 2600/41* (2013.01); *E05Y 2900/20* (2013.01)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 1,835,042 A * 12/1931 Hammer ..... E05D 7/009 248/225.11
4,232,423 A * 11/1980 Schnelle ..... E05D 5/0276 16/259

(Continued)

FOREIGN PATENT DOCUMENTS

AT 502963 A2 * 6/2007 ..... E05F 5/006
CN 1271063 10/2000

(Continued)

OTHER PUBLICATIONS

Search Report dated May 26, 2022 in corresponding Chinese Patent Application No. 202080014198.2.

(Continued)

*Primary Examiner* — Chuck Y Mah
(74) *Attorney, Agent, or Firm* — Wenderoth, Lind & Ponack, L.L.P.

(57) ABSTRACT

An arrangement includes a furniture hinge for pivotally connecting a furniture part movably-supported relative to a furniture carcass, and a fastening adaptor for fastening the furniture hinge to the furniture carcass. The furniture hinge includes at least two fitting portions hingedly connected to one another, and at least one of the fitting portions of the furniture hinge is configured to be at least partially countersunk within a plate-shaped member of the furniture carcass. The fastening adaptor includes at least one fastening device configured to be fixed to the furniture carcass, and at least one recess for at least partially receiving the countersinkable fitting portion of the furniture hinge.

19 Claims, 4 Drawing Sheets

(58) Field of Classification Search
CPC .... E05F 5/02; E05F 3/20; E05F 11/54; E05D 7/04; E05D 11/00; E05D 15/40; E05D 15/401; E05D 2003/163; E05D 3/06; E05D 3/12; E05D 3/16; E05Y 2201/10; E05Y 2201/256; E05Y 2201/21; E05Y 2201/264; E05Y 2201/47; E05Y 2201/492; E05Y 2201/416; E05Y 2201/474; E05Y 2900/20; E05Y 2900/202; E05Y 2600/10; E05Y 2600/41; A47B 2220/0072; Y10T 16/5383; Y10T 16/547; Y10T 16/5476; Y10T 16/5321; Y10T 16/5322; Y10T 16/53225
See application file for complete search history.

(56) References Cited

U.S. PATENT DOCUMENTS

| | | | | |
|---|---|---|---|---|
| 4,397,064 | A * | 8/1983 | Lautenschlager | E05D 7/0423 403/231 |
| 4,847,948 | A | 7/1989 | Gross et al. | |
| 5,806,144 | A * | 9/1998 | Fries | E05D 7/12 16/246 |
| 6,418,589 | B1 | 7/2002 | Salice | |
| 6,502,282 | B1 * | 1/2003 | King | E05D 7/04 16/388 |
| 6,648,431 | B1 * | 11/2003 | King | E05D 5/046 16/382 |
| 6,760,955 | B2 | 7/2004 | Salice | |
| 6,959,498 | B1 * | 11/2005 | Klonowski, III | B23B 47/287 33/667 |
| 7,509,708 | B1 * | 3/2009 | Radke | E05D 7/081 16/245 |
| 10,407,963 | B2 | 9/2019 | Salice | |
| 10,837,210 | B2 | 11/2020 | Yamaguchi | |
| 11,072,959 | B2 * | 7/2021 | Stuke | E05F 5/006 |
| 2002/0141815 | A1 | 10/2002 | Salice | |
| 2004/0239216 | A1 * | 12/2004 | Castillo | E05D 15/58 312/322 |
| 2005/0060841 | A1 * | 3/2005 | Chen | E05D 7/0407 16/240 |
| 2005/0251963 | A1 * | 11/2005 | Pozzi | E05D 7/123 16/272 |
| 2007/0257538 | A1 * | 11/2007 | Brunnmayr | E05D 15/262 297/423.12 |
| 2008/0209677 | A1 * | 9/2008 | Herper | E05D 7/0407 16/233 |
| 2014/0033478 | A1 * | 2/2014 | Kleemann | E05D 3/16 16/384 |
| 2015/0240546 | A1 * | 8/2015 | Oshima | E05F 1/1041 16/80 |
| 2015/0361699 | A1 | 12/2015 | Manzoni | |
| 2016/0281403 | A1 * | 9/2016 | Arai | E05D 7/125 |
| 2017/0362866 | A1 * | 12/2017 | Lizotte | E05D 3/02 |
| 2018/0252011 | A1 | 9/2018 | Yamaguchi | |
| 2018/0252016 | A1 | 9/2018 | Salice | |
| 2019/0071908 | A1 * | 3/2019 | Salice | E05D 3/142 |
| 2019/0316394 | A1 * | 10/2019 | Kruedener | E05D 7/123 |
| 2019/0368247 | A1 * | 12/2019 | Carbone | E05D 3/14 |
| 2019/0380496 | A1 | 12/2019 | Poppenborg | |
| 2021/0148149 | A1 * | 5/2021 | Pleuteri | E05D 3/12 |
| 2021/0277698 | A1 | 9/2021 | Capur et al. | |

FOREIGN PATENT DOCUMENTS

| | | | | |
|---|---|---|---|---|
| CN | 2721828 | | 8/2005 | |
| CN | 108425579 | | 8/2018 | |
| DE | 202005016188 | U1 * | 4/2006 | E05D 11/1064 |
| DE | 10 2017 104 185 | | 8/2018 | |
| DE | 20 2017 102 809 | | 9/2018 | |
| EP | 0 269 701 | | 6/1988 | |
| EP | 2 408 987 | | 1/2012 | |
| EP | 3401482 | A1 * | 11/2018 | E05D 15/463 |
| GB | 1 447 293 | | 8/1976 | |
| IT | MI20100555 | | 10/2011 | |
| JP | 02-240384 | | 9/1990 | |
| JP | 2008-25269 | | 2/2008 | |
| JP | 2011-19682 | | 2/2011 | |
| JP | 2013-91925 | | 5/2013 | |
| JP | WO2017/038228 | | 3/2017 | |
| WO | 87/07672 | | 12/1987 | |
| WO | 2010/105281 | | 9/2010 | |
| WO | 2016/156514 | | 10/2016 | |
| WO | 2016/174071 | | 11/2016 | |

OTHER PUBLICATIONS

International Search Report dated Apr. 2, 2020 in International (PCT) Application No. PCT/AT2020/060008.

* cited by examiner

FURNITURE HINGE

BACKGROUND OF THE INVENTION

The present invention relates to an arrangement comprising a furniture hinge for pivotally connecting a furniture part movably-supported relative to a furniture carcass, and a fastening adaptor for fastening the furniture hinge to the furniture carcass. The furniture hinge includes at least two fitting portions hingedly connected to one another, and at least one of the fitting portions of the furniture hinge is configured to be at least partially countersunk within a plate-shaped member of the furniture carcass.

Moreover, the invention concerns an item of furniture comprising a furniture carcass, a furniture part movably-supported relative to the furniture carcass, and at least one furniture hinge for moving the movable furniture part.

FIG. 9 of WO 2016/174071 A1 shows a furniture hinge for pivotally supporting a door, and one of the two fitting portions of the furniture hinge is received within a recess of a plate-shaped furniture member of the furniture carcass. This type of furniture hinges can be used, for example, when a household appliance (electric stove, microwave oven, refrigerator, dishwasher, tumble dryer, washing machine) shall be stored within the furniture carcass, and the household appliance extends between two opposing vertical walls of the furniture carcass. In such a case, there is no space available for arranging a furniture hinge between the household appliance and the vertical wall of the furniture carcass. Even without the arrangement of such a household appliance, a furniture hinge configured to be countersunk within a plate-shaped member of the furniture carcass offers the particular advantage that the furniture hinge is hardly visible from the outside and is, therefore, suitable for a variety of design solutions.

DE 20 2017 102 809 A1 discloses a furniture drive for moving furniture flaps, and a housing of the furniture drive is configured to be integrated within a vertically extending sidewall of the furniture carcass.

US 2015/361699 A1 discloses a furniture hinge having a hinge arm and a hinge cup hingedly connected to the hinge arm. The hinge arm is fixed within a shell to a furniture carcass, and the hinge cup can be countersunk within a recess of the movable furniture part.

Accordingly, at least one fitting portion of such furniture hinges is configured to be countersunk within a plate-shaped member of the furniture carcass, thus within a horizontally extending top panel or within a horizontally extending bottom panel of the furniture carcass for example. When the door to be moved by the furniture hinges exceeds a certain height, the arrangement of an additional furniture hinge becomes necessary. However, such an additional furniture hinge can only be arranged when the furniture carcass includes an intermediate shelf of a traverse panel in which the fitting portion of the furniture hinge can be countersunk.

Moreover, there are mounting situations in which the furniture carcass includes only one horizontally extending first furniture panel in which a fitting portion of a first furniture hinge can be countersunk. In order to arrange a second furniture hinge, a second furniture panel is required. However, such a second furniture panel is frequently not present (for example in the case if a washbasin or a cooking zone projects through a kitchen worktop). Accordingly, there is the lack of a possibility to duly fix a second furniture hinge to the furniture carcass for pivotally supporting a door.

SUMMARY OF THE INVENTION

It is an object of the present invention to propose a furniture hinge of the type mentioned in the introductory part, thereby avoiding the above-discussed drawbacks. The mounting of such a furniture hinge to the furniture carcass shall also be possible without the presence of an intermediate shelf or a traverse panel.

According to the invention, the fastening adaptor includes at least one fastening device configured to be fixed to the furniture carcass, and at least one recess for at least partially receiving the countersinkable fitting portion of the furniture hinge.

That fitting portion of the furniture hinge, that is otherwise to be countersunk within the plate-shaped furniture member, can thus be at least partially received within the recess of the fastening adaptor, and the fastening adaptor is configured to be fixed to the furniture carcass by the at least one fastening device. In a mounted position of the furniture hinge on the furniture carcass, the furniture hinge—jointly with the fastening adaptor—is fixed to the plate-shaped furniture member, and—apart from fastening means of the fastening adaptor—can be entirely arranged outside of that plate-shaped furniture member to which the fastening adaptor is fixed.

According to an embodiment, a contour of the recess of the fastening adaptor is substantially adapted to a contour of the fitting portion.

The fitting portion of the furniture hinge, in a connected condition with the fastening adaptor, is for the most part, preferably substantially entirely, received within the recess of the fastening adaptor.

The recess of the fastening adaptor can be configured substantially pocket-shaped (that is to say as a blind hole). On the contrary, the fitting portion can include a, preferably cuboidal, housing configured to be received for the most part, preferably substantially entirely, within the recess of the fastening adaptor.

The housing of the furniture hinge can have a height extension and a longitudinal extension, and the longitudinal extension is at least three times, preferably at least six times, as large as the height extension.

The fastening adaptor, in a mounted condition, can protrude transversely from the furniture carcass. In other words, the fastening adaptor has a pair of short sides and a pair of long sides, and one of the short sides of the fastening adaptor is fixed to a sidewall of the furniture carcass while the long sides of the fastening adaptor protrude outwardly (transversely) from the sidewall of the furniture carcass.

The fastening device can include at least one opening for the passage of a screw. As an alternative or in addition thereto, the fastening device can include at least one screw pre-mounted to the fastening adaptor.

According to a preferred embodiment of the invention, the arrangement can additionally include a mounting member configured to be pre-mounted to the furniture carcass, and the fastening adaptor is configured to be connected, preferably releasably lockable, with the mounting member to be pre-mounted to the furniture carcass.

The fastening device of the fastening adaptor can include a locking device, the locking device having at least one resilient locking element or a locking element pressurized by a force storage member. The locking element is configured to be releasably lockable with the mounting member. The locking device can include at least one holding element, for example a cylindrical pin, configured to engage into a notch of the mounting member in a connected condition with the mounting member.

BRIEF DESCRIPTION OF THE DRAWINGS

Further details and advantages of the present invention will be explained with the aid of the following description of figures.

DETAILED DESCRIPTION OF THE INVENTION

Figure 1:
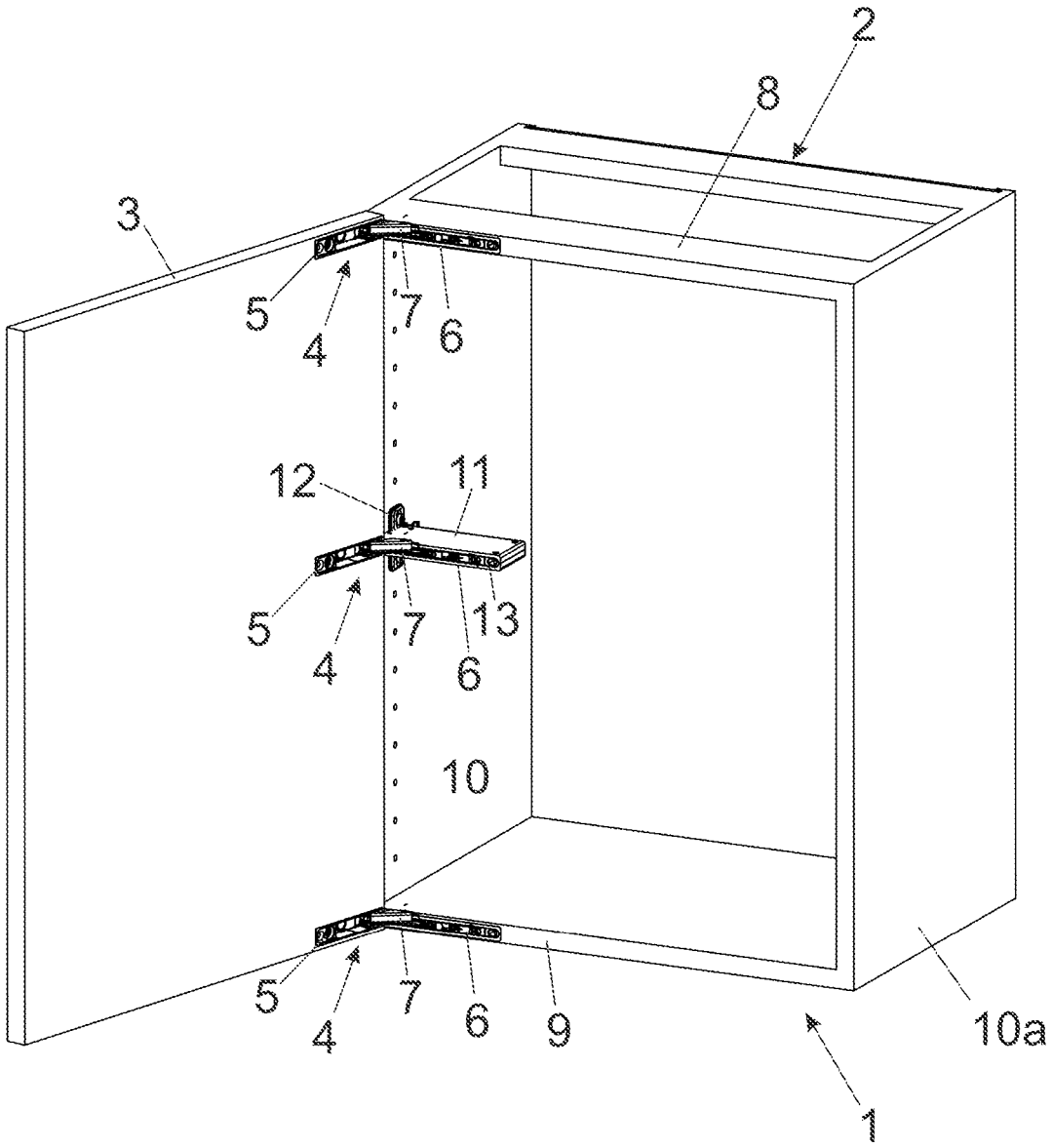
FIG. 1 is a perspective view of an item of furniture with a furniture carcass and a furniture part movably-supported relative thereto.

FIG. 1 shows a perspective view of an item of furniture 1 with a furniture carcass 2 and furniture part 3 movably-supported relative to the furniture carcass 2. The furniture carcass 2 includes a horizontally extending top panel 8, two vertical sidewalls 10, 10*a* mutually spaced from one another in a parallel relationship, and a horizontally extending bottom panel 9. In the shown embodiment, the movable furniture part 3 is pivotally supported by furniture hinges 4 relative to the furniture carcass 2 about a vertically extending axis. Each of the furniture hinges 4 includes two fitting portions 5, 6 hingedly connected to one another by at least one hinge lever 7. At least one of the fitting portions 5, 6 of the furniture hinges 4 is configured to be at least partially countersunk within a plate-shaped member (that is to say, for example, within the top panel 8, within the bottom panel 9 or within the sidewall panels 10, 10*a*) of the furniture carcass 2. In the shown embodiment, both fitting portions 5, 6 of the furniture hinges 4 are at least partially, preferably substantially entirely, countersunk within a plate-shaped member, preferably having a material thickness of less than 20 mm. In order for the fitting portions 5, 6 to be countersunk in the associated plate-shaped member of the furniture carcass 2, corresponding recesses for receiving the fitting portions 5, 6 are to be provided in the plate-shaped members.

While the arrangement of the furniture hinges 4 within the top panel 8 and/or within the bottom panel 9 is largely unproblematic, the attachment of a furniture hinge 4 located between the top panel 8 and the bottom panel 9 is usually connected with difficulties, because there is no shelf or a traverse panel available for this purpose. The three furniture hinges 4 arranged above one another can be configured to be identical, so that the pivoting axes of the furniture hinges 4 are aligned flush with one another in the vertical direction. In this way, one single type of furniture hinge 4 can be utilized for the two different mounting methods (within the top panel 8 and within the bottom panel 9 on the one hand, and to the sidewall 10 on the other hand).

For mounting the furniture hinge 4 to the sidewall 10, a fastening adaptor 11 is provided. The fastening adaptor 11 includes at least one fastening device 12 for fixing the fastening adaptor 11 to the furniture carcass 2. The fastening adaptor 11 further includes at least one, preferably pocket-shaped, recess 13 for at least partially receiving the fitting portion 6. The fastening device 12 configured to be fixed to the furniture carcass 2 can include at least one opening for the passage of a screw 16 and/or a screw 16 pre-mounted to the fastening adaptor 11 and/or a locking device 14 by which the fastening adaptor 11 can be releasably locked with a mounting member 15 (FIG. 3*b*) to be fixed to the furniture carcass 2. In this way, the arrangement of an additional furniture hinge 4 can be provided. The additional furniture hinge 4 is spaced from the top panel 8 as well as from the bottom panel 9 and can be configured to be identical than the furniture hinges 4 which are to be countersunk within the top panel 8 and within the bottom panel 9.

Figure 2:
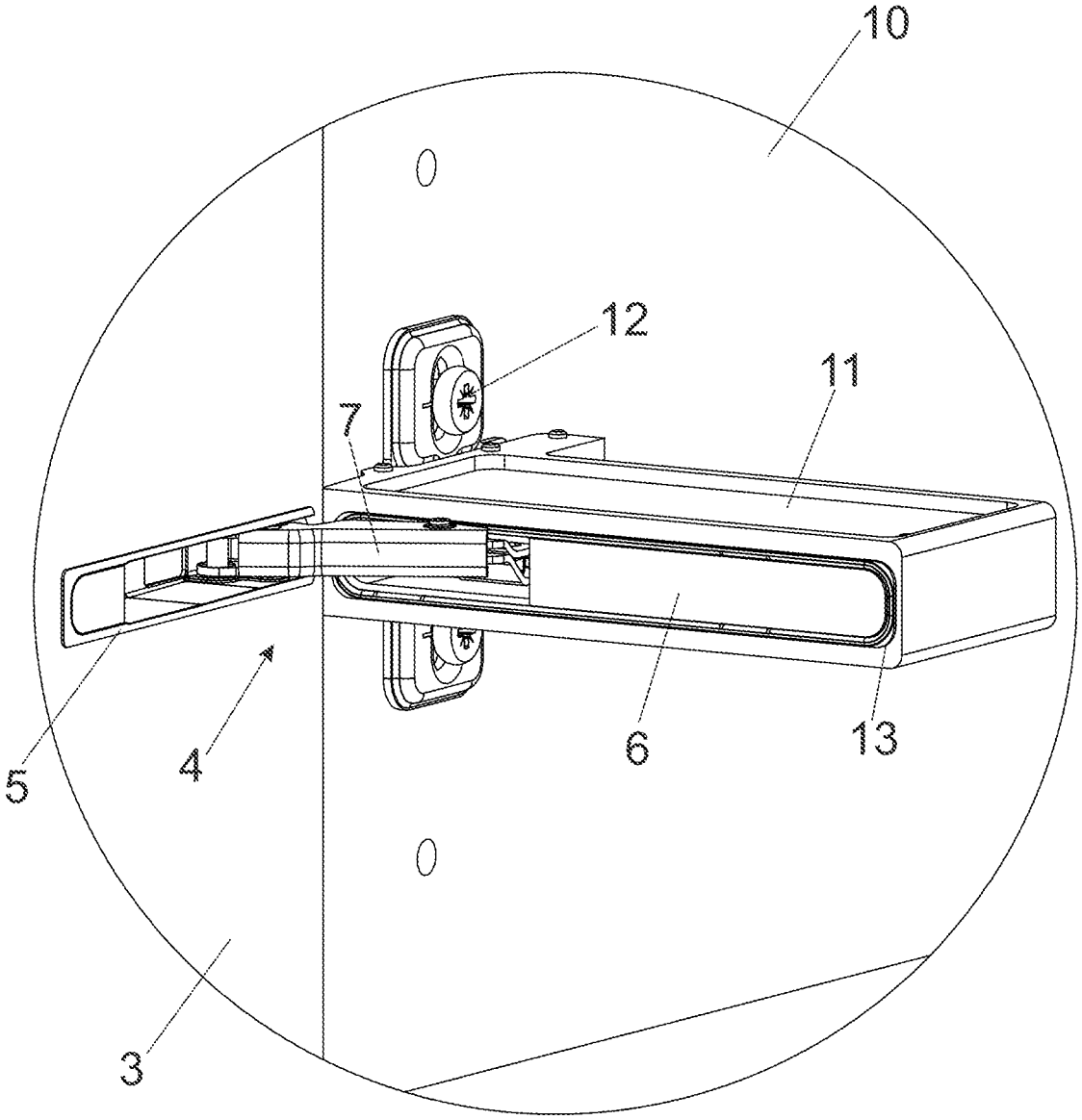
FIG. 2 is a detail view of the fastening adaptor for fixing the furniture hinge to the furniture carcass.

FIG. 2 shows a detail view of the fastening adaptor 11 for fixing the furniture hinge 4 to the furniture carcass 2, in the present case to the sidewall 10. As shown in FIGS. 1-4*b*, the fastening adaptor 11 has four end sides and a pair of opposing surfaces sandwiching the four end sides. The fastening adaptor 11 further includes at least one fastening device 12 to be fixed to the furniture carcass 2, and at least one recess 13 in an end side for at least partially receiving the fitting portion 6 of the furniture hinge 4. The contour of the recess 13 can be adapted to a contour of the fitting portion 6 such that the fitting portion 6 can be received within the recess 13 in a substantially form-locking manner. The other fitting portion 5 is, for the most part, preferably substantially entirely, received within a recess arranged within the movable furniture part 3. In the mounted position shown in FIGS. 1 and 2, the fastening adaptor 11 mounted to the sidewall 10 projects transversely from the sidewall 10. More particularly, as shown in those Figs, the fastening adaptor 11 has a pair of short end sides and a pair of long end sides, and one of the short end sides of the fastening adaptor 11 is fixed to a sidewall 10 of the furniture carcass 2 by the fastening device 12 while the adjacent long end sides of the fastening adaptor 11 protrude outwardly (transversely) from the sidewall of the furniture carcass.

Figure 3A:
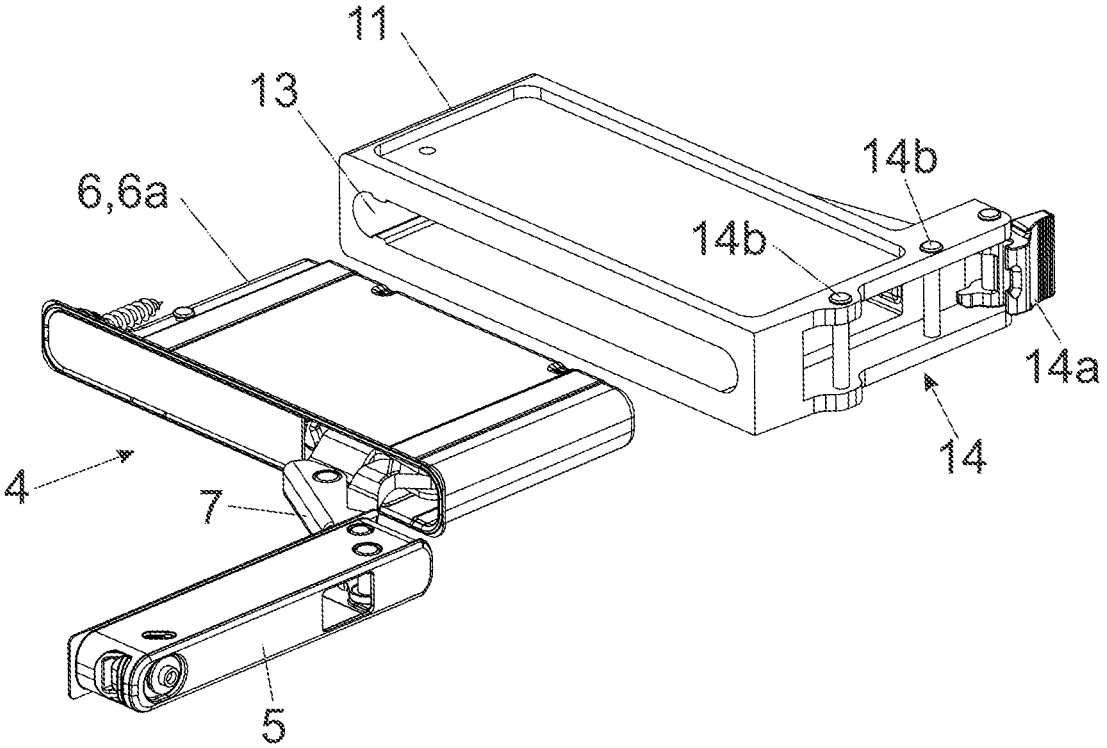
FIG. 3*a*, 3*b* show the furniture hinge and the fastening adaptor in a released condition and in a connected condition.

FIG. 3*a* shows the furniture hinge 4 and the fastening adaptor 11 in a released condition. The fitting portion 6 can include, for example, a cuboidal housing 6*a* configured to be at least partially, preferably substantially entirely, received within the recess 13 of the fastening adaptor 11. The housing 6*a* can have a height extension and a longitudinal extension, and the longitudinal extension is at least three times, preferably at least six times, as large as the height extension. The fastening device 12 of the fastening adaptor 11 can include a locking device 14 for releasably locking the fastening adaptor 11 with a mounting member 15 (FIG. 3*b*) to be fixed to the furniture carcass 2. The locking device 14 includes at least one holding element 14*b*, for example in the form of a cylindrical pin. The holding element 14*b*, in a connected condition with the mounting member 15, engages into notches 17 of the mounting member 15. Moreover, the locking device 14 can include at least one locking element 14*a*, the at least one locking element 14*a* being resilient or being pressurized by a force storage member and being configured to be releasably lockable with the mounting member 15.

Figure 3B:
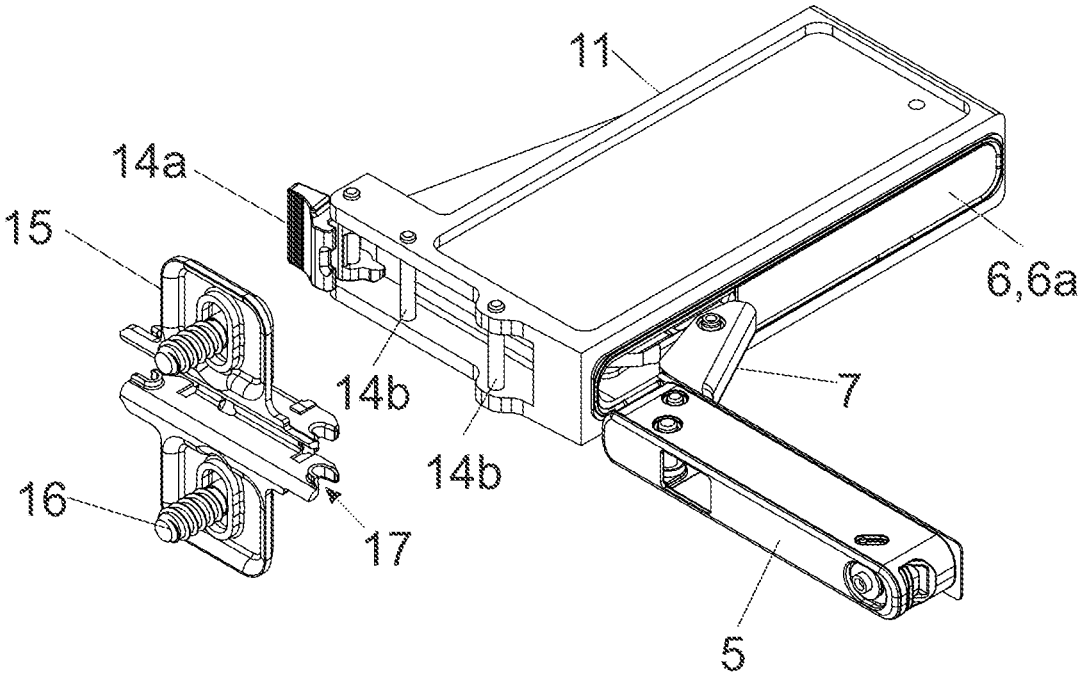

FIG. 3*b* shows the furniture hinge 4 and the fastening adaptor 11 in a connected condition, and the housing 6*a* of the fitting portion 6 is substantially entirely received within the recess 13 of the fastening adaptor 11. The mounting member 15 can be pre-mounted to the furniture carcass 2 by at least one screw 16, and the fastening adaptor 11 is releasably lockable with the mounting member 15 pre-mounted to the furniture carcass 2. For mounting the fastening adaptor 11, a holding element 14*b* is firstly introduced into a notch 17 of the mounting member 15. Subsequently, the fastening adaptor 11 can be releasably locked with the mounting member 15 by the movably-supported locking element 14*a*. The mounting member 15 can be configured as a standard component by which also furniture hinges known from the prior art of a different type, in particular furniture hinges having a hinge cup, can be fixed to the furniture carcass 2.

Figure 4A:
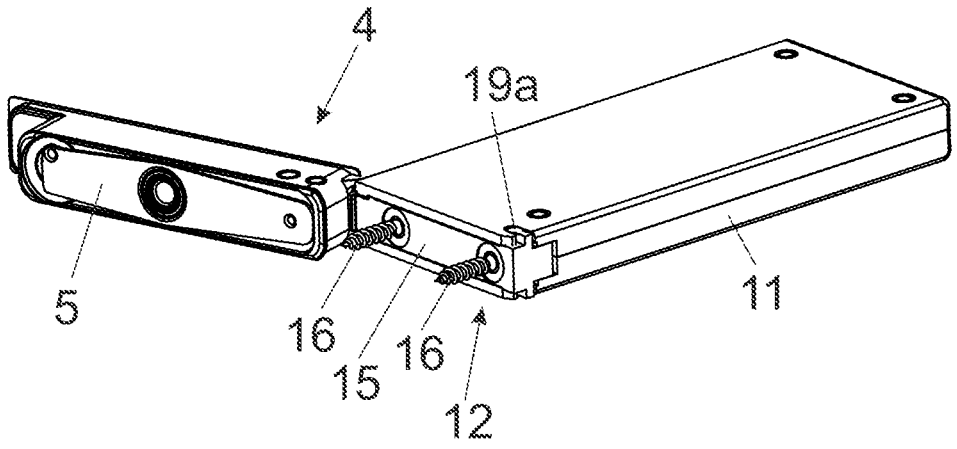
FIG. 4*a*, 4*b* show an alternative fixing of the fastening adaptor to the furniture carcass.

FIG. 4*a* shows an alternative fixing of the fastening adaptor 11 to the furniture carcass 2. The fastening device 12 includes a mounting member 15 configured to be fixed to the furniture carcass 2, and the mounting member 15 can be pre-mounted to the furniture carcass 2 by screws 16. The fastening adaptor 11 is configured to be releasably connected to the pre-mounted mounting member 15 by sliding, by snapping or by pushing the fastening adaptor 11 onto the pre-mounted mounting member 15.

Figure 4B:
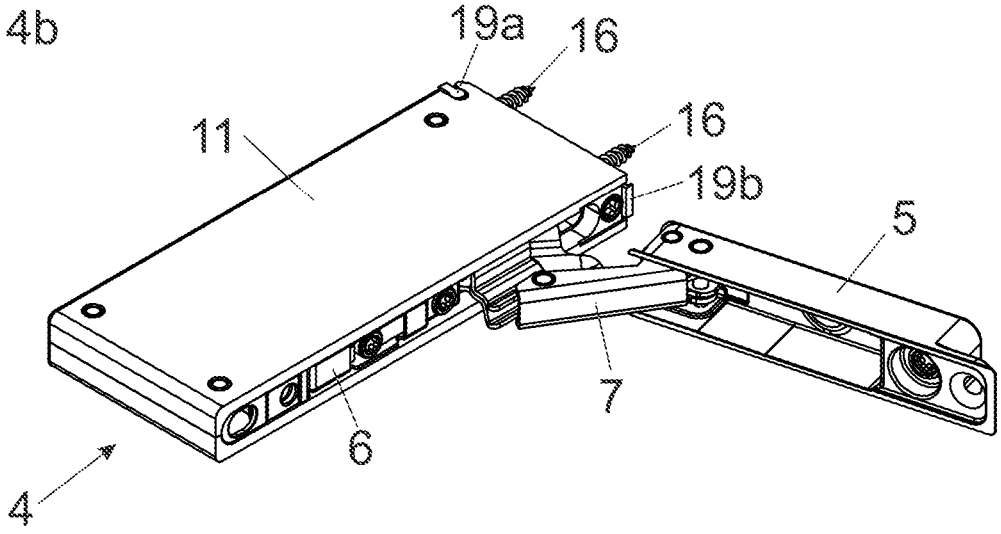

FIG. 4*b* shows the embodiment according to FIG. 4*a* in a further perspective view. In a first mounting step, the mounting member 15 is to be fixed to the furniture carcass 2 by screws 16. In a further mounting step, the fastening adaptor 11 can be hung into a first bearing location 19*a* of the mounting member 15, can then be pivoted about the first bearing location 19*a* and can be subsequently releasably connected to the mounting member 15 by a second bearing location 19*b*, the second bearing location 19*b* preferably having a resilient catch.

The invention claimed is:

1. An arrangement comprising:

a furniture hinge for pivotally connecting a movable furniture part to a furniture carcass; and a fastening adaptor for fastening the furniture hinge to the furniture carcass, wherein the furniture hinge includes at least two fitting portions hingedly connected to one another, a first one of the at least two fitting portions being configured to be at least partially countersunk within a panel of the furniture carcass, wherein the fastening adaptor includes four end sides and a pair of opposing surfaces sandwiching the four end sides, a fastening device configured to be fixed to the furniture carcass, and a recess for at least partially receiving the first one of the at least two fitting portions of the furniture hinge, wherein the first one of the at least two fitting portions includes a housing, the housing being configured to be received within the recess of the fastening adaptor, and wherein a first end side of the four end sides of the fastening adaptor is to be mounted against a sidewall of the furniture carcass via the fastening device such that a second end side and a third end side of the four end sides of the fastening adaptor adjacent to the first end side project transversely from the furniture carcass when mounted.

2. The arrangement according to claim 1, wherein a contour of the recess of the fastening adaptor is substantially adapted to a contour of the first one of the at least two fitting portions.

3. The arrangement according to claim 1, wherein an entirety of the first one of the at least two fitting portions is at least partially received within the recess of the fastening adaptor.

4. The arrangement according to claim 3, wherein the entirety of the first one of the at least two fitting portions is to be substantially entirely received within the recess of the fastening adaptor.

5. The arrangement according to claim 1, wherein the recess of the fastening adaptor is substantially pocked-shaped.

6. The arrangement according to claim 1, wherein the housing of the fitting portion is substantially cuboidal, and the housing is configured to be substantially entirely received within the recess of the fastening adaptor.

7. The arrangement according to claim 1, wherein the housing of the first one of the at least two fitting portions of the furniture hinge has a height extension and a longitudinal extension, and the longitudinal extension is at least three times as large as the height extension.

8. The arrangement according to claim 7, wherein the longitudinal extension is at least six times as large as the height extension.

9. The arrangement according to claim 1, wherein the first end side and a fourth end side of the fastening adaptor opposite the first end side are shorter than the second end side and the third end side adjacent to the first end side, and the recess of the fastening adaptor is in one of the second end side and the third end side.

10. The arrangement according to claim 1, wherein the fastening device includes an opening to allow passage of a screw.

11. The arrangement according to claim 1, wherein the fastening device includes a screw pre-mounted to the fastening adaptor.

12. The arrangement according to claim 1, wherein the fastening adaptor is configured to be releasably lockable to the mounting member pre-mounted to the furniture carcass.

13. An arrangement comprising:

a furniture hinge for pivotally connecting a movable furniture part to a furniture carcass;

a fastening adaptor for fastening the furniture hinge to the furniture carcass, and a mounting member configured to be pre-mounted to the furniture carcass, wherein the furniture hinge includes at least two fitting portions hingedly connected to one another, a first one of the at least two fitting portions being configured to be at least partially countersunk within a panel of the furniture carcass, and wherein the fastening adaptor includes a fastening device configured to be fixed to the furniture carcass and a recess for at least partially receiving the first one of the at least two fitting portions of the furniture hinge, wherein the fastening adaptor is configured to be releasably connected with the mounting member pre-mounted to the furniture carcass.

14. The arrangement according to claim 13, wherein the fastening device of the fastening adaptor includes a locking device having a locking element, the locking element being resilient or being pressurized by a force storage member and being configured to be releasably locked with the mounting member.

15. The arrangement according to claim 14, wherein the locking device includes a holding element, the holding element being configured to engage into a notch of the mounting member in a connected condition with the mounting member.

16. The arrangement according to claim 15, wherein the holding element of the locking device is a cylindrical pin.

17. An item of furniture comprising:

a furniture carcass;

a movably-supported furniture part; and the arrangement according to claim 1 for allowing movement of the furniture part relative to the furniture carcass.

18. The item of furniture according to claim 17, wherein the furniture carcass includes a top panel, a bottom panel, and a sidewall extending between the top panel and the bottom panel, wherein the furniture hinge of the arrangement is fixed to the sidewall of the furniture carcass via the fastening adaptor.

19. The arrangement according to claim 13, wherein the fastening adaptor is configured to be releasably lockable to the mounting member pre-mounted to the furniture carcass.

* * * * *